US007331476B2

(12) United States Patent
Yerly

(10) Patent No.: US 7,331,476 B2
(45) Date of Patent: Feb. 19, 2008

(54) LIFTING APPLIANCE

(76) Inventor: Jean-Marc Yerly, Zone Industrielle A, Domdidier, Ju (CH) 1564

( * ) Notice: Subject to any disclaimer, the term of this patent is extended or adjusted under 35 U.S.C. 154(b) by 0 days.

(21) Appl. No.: 10/571,982

(22) PCT Filed: Sep. 14, 2004

(86) PCT No.: PCT/CH2004/000577

§ 371 (c)(1),
(2), (4) Date: Mar. 15, 2006

(87) PCT Pub. No.: WO2005/026036

PCT Pub. Date: Mar. 24, 2005

(65) Prior Publication Data

US 2006/0283826 A1 Dec. 21, 2006

(30) Foreign Application Priority Data

Sep. 15, 2003 (EP) ..... 03405677

(51) Int. Cl.
*B66C 23/76* (2006.01)

(52) U.S. Cl. ..... 212/196; 212/279; 212/198

(58) Field of Classification Search ..... 212/195–198, 212/300, 256, 279
See application file for complete search history.

(56) References Cited

U.S. PATENT DOCUMENTS

| | | | | |
|---|---|---|---|---|
| 834,647 | A * | 10/1906 | Toomey | 254/321 |
| 2,521,861 | A * | 9/1950 | Mathias | 212/300 |
| 2,703,180 | A * | 3/1955 | Brown | 212/239 |
| 3,062,384 | A * | 11/1962 | Pollack | 212/256 |
| 2004/0026350 | A1 | 2/2004 | Yerly | |

FOREIGN PATENT DOCUMENTS

| | | | |
|---|---|---|---|
| DE | 261429 | | 6/1913 |
| DE | 279083 | | 10/1914 |
| DE | 289839 | | 1/1916 |
| DE | 1260733 | | 2/1968 |
| DE | 3438937 | A1 | 4/1986 |
| EP | 0379448 | | 7/1990 |
| EP | 1 057 776 | A1 * | 6/2000 |
| EP | 1057776 | | 12/2000 |
| FR | 2605619 | | 4/1988 |

* cited by examiner

*Primary Examiner*—Thomas J Brahan
(74) *Attorney, Agent, or Firm*—Clifford W. Browning; Krieg DeVault LLP

(57) ABSTRACT

A machine for lifting and handling loads with an orientable articulated placing jib, comprising a mast with a rotating pivot, an articulated jib (16) comprising a jib foot (19), articulated at its first end on the top of the mast by a horizontal rotation axis (27), a jib head member (18) articulated for rotation by a horizontal articulation axis (32) at the second end of the jib foot, a jib holding assembly comprising at least one stanchion (7), a jib holding line (11) and a moving counterweight (100) connected to the jib by the said holding line. The counterweight is made to follow a guiding track (1) with a variable slope (α), integral with the rotating pivot, supporting the said counterweight, arranged opposite to the jib, and where the variations in slope (α) are chosen so that the counterweight exerts a set of variable forces on the said jib and on the structure of the said machine, helping to balance the machine during movements of deployment/retraction of the jib in articulated working mode.

21 Claims, 9 Drawing Sheets

LIFTING APPLIANCE

Applicant claims foreign priority benefits under 35 U.S.C. §§119(a)-(d) or (b), or §365(b) of European Patent Application No. 03405677.0 filed Sep. 15, 2003.

The present invention concerns a machine for lifting and handling loads with an orientable articulated placing jib, comprising a mast with a rotating pivot, an articulated jib comprising a jib foot, articulated at its first end on the top of the mast by means of a horizontal rotation shaft, a jib head member articulated for rotation by means of a horizontal articulation shaft on the second end of the jib foot, a jib holding assembly comprising at least one stanchion, a jib holding line and a moving counterweight connected to the jib by the said holding line.

In order to allow the handling of loads on construction sites, use is normally made of cranes with a horizontal orientable placing jib, on which a crab slides serving to guide load suspension means.

In certain circumstances, for example when sites are crowded or when legislation prohibits travelling over land adjacent to the site, cranes with a luffing and orientable placing jib are preferred to them. Cranes with a luffing placing jib have the advantage, compared with cranes with a horizontal jib, of being able to bring loads to greater heights, for comparable mast heights. The force of the deadweight of a jib operating in luffing working mode varies considerably between the positions of the jib close to the horizontal and the raised position close to the vertical. This is why this type of crane is sometimes provided with a moving counterweight, the position of which varies according to the angle formed by the jib with the horizontal.

The document DE 3438937 describes a crane with a luffing jib, with a platform at the top of the mast, carrying a counterweight disposed at one end of a rocking arm. The position of the arm is slaved to the angular position of the jib, fixed to the other end of the rocking arm, so that the counterweight is situated close to the rotation axis of the mast when the jib is raised, and moves away from it in a pendular movement when the jib inclines towards the horizontal. This device gives little assistance to the lifting operation for high lifting angles. This type of crane always requires a lifting motor device with high torque.

The document EP 379448 describes a luffing jib crane comprising a rotating pivot, on which the jib is mounted, a platform carrying the jib luffing and load lifting mechanisms as well as a moving counterweight, fixed at the rear of the pivot, opposite to the jib. The counterweight is mounted so as to travel on rectilinear longitudinal members of the platform, which has a slight slope directed towards the axis of the mast. The counterweight is connected by a holding tie rod to the jib, via a return pulley, so as to move away from the mast when the jib is lowered towards the horizontal and to move closer to the mast when the jib is raised. This device compensates for the moment of the dead weight of the jib on the structure of the mast, but luffing requires a mechanism supplying a very high torque.

Use can also be made of cranes of the port type, with an articulated orientable horizontal placing jib, effecting a movement of the load, moving the latter respectively away from and closer to the pivot axis of the crane by the deployment and respectively the retraction of the jib. The moment of the inherent weight of a jib of this type varies considerably between the deployed position of the jib and the position folded back towards the mast. It is difficult to balance these variations in force by a single moving counterweight.

The document DE 1260733 describes a crane of this type and proposes to reduce or even omit the counterweight and use a distribution return cable, fixed to the end of the tip of the jib head member, cooperating with a jib holding cable acting on the end of the counter jib head member, via stanchions and return pulleys, these two cables being actuated by winches. The use of these winches requires motors with a very high torque.

The patent FR 2605619 describes a collapsible lifting machine which combines the effect of a crane with an articulated placing jib with those of a crane with a luffing placing jib, thus conferring on it a certain versatility. However, because of the design of the articulations of the extending jib, this crane always has a great minimum reach. In addition, the gain in hook height when the tip of the jib is raised remains relatively small, and cannot exceed an angular amplitude greater than 30° with respect to the horizontal.

The patent application EP 1057776 of the applicant describes a collapsible lifting machine with an orientable placing jib capable of working in articulated mode or luffing mode. The jib consists of a jib foot, the first end of which is mounted on the top of the mast, and a jib head member mounted for articulation on the second end of the jib foot, this jib head member being delimited by this articulation in two parts, namely a counter jib head member and a jib head member tip. The counter jib head member and the part of the jib foot closest to the articulation are conformed so that the jib foot and the jib head member can come into alignment in raised working mode, which increases both the horizontal reach and the maximum hook height of the machine. This device uses a distribution cable not held by guides over a great length when the jib is almost entirely deployed, and hence there are problems of stability in rotation and distribution under load and a facing wind.

The patent application WO 02/04336 of the applicant describes a collapsible lifting machine and tower cranes, with luffing articulated orientable placing jibs, and with inclinable jib head members. The part of the jib foot close to the jib head member and the counter jib head member have conjugate shapes enabling the tip of the jib head member to come into position aligned with the jib foot in luffing working mode. A system of rams is arranged at the articulation between the jib foot and the jib head member in order to provide the deployment and retraction of the jib in horizontal or inclinable articulated working mode. A system of moving counterweights balances the crane in all working positions: this system comprises in combination a fixed counterweight, for example at the end of the mechanism platform, a main pendular counterweight and a second correcting rocking counterweight. The adjustment of the masses and positions of the three counterweights makes it possible to balance these cranes in an optimum fashion in the various luffing, inclinable and articulated working modes.

However, the functioning of such a counterweight system may prove to be tricky to adjust. The length of the arm of the pendular counterweight gives rise to a large space requirement below the platform. In addition, the mechanism of the articulation of the jib, consisting of jacks, is relatively expensive, its control lacks precision and its weight helps to make the whole of the jib heavier.

The aim of the present invention is to propose a lifting machine of the type defined at the start which does not have the drawbacks mentioned above.

The aim of the present invention is in particular to propose a lifting machine having the same character of versatility in use as that described in the document WO 02/04336 whilst lowering the manufacturing cost, simplifying use and, in addition, reducing the space requirement below the platform.

These aims are achieved by virtue of a counterweight made to follow a guiding track with a variable slope ($\alpha$), integral with the rotating pivot, supporting the said counterweight, arranged opposite the jib, and where the variations in slope ($\alpha$) are chosen so that the counterweight exerts a set of variable forces on the said jib and on the structure of the said machine, contributing to balancing the machine during movements of deployment/retraction of the jib in articulated working mode.

The moving counterweight exerts, via simply the jib retaining line or slings, a traction on this jib, the intensity of which is a function of the local slope of the guiding track at the position of the counterweight. The moving counterweight also exerts a bearing force on the guiding track, which results in a torque exerted on the structure of the machine fixed to the guiding track, this torque being a function of the distance between the counterweight and the axis of the mast, and also the local slope at the position of the counterweight.

The jib holding assembly of the lifting machine according to the invention can comprise only one holding line. It is however, preferable to employ a set of two lines and two stanchions with their respective return pulleys, the lines being arranged and attached on each side of the jib, disposed symmetrically with respect to the symmetry plane thereof. The disclosure below describes, for reasons of didactic simplification, a lifting machine equipped with one holding line. It applies mutatis mutandis to a lifting machine equipped with two lines.

The guiding track according to the invention is arranged opposite to the jib, that is to say, seen in vertical projection on a horizontal plane, it extends in the direction opposite to the projection of the jib, with respect to the rotation axis of the mast. Moreover, in side view, it has a curved profile, the variations in slope being chosen by the manufacturer according to the forces required by the jib.

The guiding track preferably has in its first portion, closest to the mast, a low slope, lower than the slope of a second portion of the track, further away from the mast. The guiding track may have two or more slope portions that are constant but different, preferably connected together by a rounded part. The guiding track may have a more complex profile. The guiding track may have a curved profile, in particular a sigmoidal profile.

Preferably, in order to minimise the friction forces, the moving counterweight is provided with running means, such as wheels or rollers, and the guiding track can comprise one or more rails on which the said running means roll. Such a running track can be produced by means of a pair of curved rails, parallel to each other, and the counterweight can consist of a crab with rollers, able to move on these rails, and ballast elements carried by the said crab.

The guiding track could also consist of a plurality of rollers on which the moving counterweight slides, or any equivalent mechanical system.

A counterweight of weight P placed on the guiding track, when it is situated at a distance x from the axis of the mast, in an area where the guiding track forms an angle $\alpha$ with the horizontal, exerts on the one hand a return force F on the jib via the holding line and the return pulleys, and on the other hand a bearing force on the guiding track which generates a torque C exerted on the crane structures, opposing the torque exerted by the inherent weight of the jib and the lifting load on the mast.

As a first approximation, these forces correspond to the two components of the vector P, respectively parallel and perpendicular to the guiding track, and $$F \cong P.\sin\alpha \quad \text{(I)}$$

$$C \cong P.x \quad \text{(II)}$$

However, according to the invention, $\alpha$ varies as a function of x, the function $\alpha(x)$ being determined by the choice of the curved profile of the guiding track made by the crane manufacturer. The distance x of the counterweight with respect to the axis of the mast being itself a decreasing function of the angle formed by the jib foot with the horizontal, because of the connection via the holding line, the choice of the profile of the guiding track according to the invention makes it possible to modulate a return component of the jib, so that all the return and bearing forces automatically balance the crane during the movements of the crane in articulated working mode, and can assist the mechanism or mechanisms operating the deployment and retraction of the jib, such as jacks, motors and winches. If the crane is operating in luffing mode, this return component automatically assists the jib luffing mechanism.

Equations (I) and (II) are given only by way of illustration of the principle of the invention. They do not take account of correction factors relating to the positions in terms of elevation of the centre of gravity of the counterweight, the attachment points of the holding line or lines and the return pulleys. These equations do not therefore define limitations to the extent of the protection sought.

The use of this variable return component in luffing or articulated working mode or with an inclinable jib head member makes it possible to employ mechanical luffing devices offering lower maximum torque and maximum power.

The use of this variable return component of the counterweight also allows the employment of less powerful, lighter and more economical devices than a system of hydraulic jacks, for example electric winches, in order to operate the jib in articulated working mode for the horizontal distribution of the loads.

The reaction time of an electric motor system is more rapid than that of a system based on hydraulic jacks, which is disadvantaged by the great length of the conduits. The use of an electric motor system therefore improves the comfort of the crane drive. Finally, maintenance is also less and easier.

The counterweight system according to the invention can be applied

- to lifting machines with an articulated placing jib or
- to machines with a luffing jib, or
- to machines with an articulated and luffing jib, or again
- to machines with an articulated and luffing jib and an inclinable jib head member.

The counterweight system according to the invention can in particular be used for machines whose jib comprises a jib foot articulated at the top of the mast by its first end, a jib head member articulated for rotation at the second end of the jib foot, the said jib head member comprising on each side of its articulation axis on the jib foot respectively a jib head member tip and a counter jib head member, the said second end of the jib foot and the counter jib head member having conjugate shapes enabling the jib head member tip to come into a position aligned with the jib foot in the luffing working position, the end of the jib holding line being fixed to the jib head member.

The counterweight system according to the invention can be used not only for tower cranes but also for lifting machines with self-erecting collapsible masts.

The general architecture of such luffing machines, and in particular of the advantageous structures and forms of jib feet and jib head members, are described in the document WO 02/04336, the content of which is incorporated in the present application by reference. The counter jib head member and the second end of the jib foot can have conjugate prismatic profiles and come into contact with each other when the jib foot and jib head member are aligned. According to other embodiments, the second end of the jib foot can have the form of a fork with two arms and the counter jib head member come to be housed in the space between the two arms. According to yet other embodiments, the jib foot consists of two parallel beams and the counter jib head member comes to be housed in the separation between the two beams. When the jib foot is produced in the form of a fork or in the form of two beams, the jib can comprise a jib foot/jib head member locking device such as those described in the document WO 02/043336.

According to a preferred embodiment, the rotation of the jib head member about the second end of the jib foot is effected by means of a system of opposing cables wound and unwound by means of electric winches. According to a particular embodiment, these winches, part of the cables and their return pulleys can be housed in the jib foot. More precisely, the winches are housed at the bottom of the jib foot in order to obtain better balance of the crane by taking the inherent weights of the winches as far as possible towards the centre of the mast. This location improves maintenance because the winches are situated close to the rotated pivot, that is to say the platform.

According to another preferred embodiment, the rotation of the jib head member about the end of the jib foot is effected by means of a gear system comprising a motor, a pinion and a toothed segment. According to a particular embodiment, the motor is fixed to the jib foot and, by the pinion, drives a circular toothed segment fixed to the jib head member.

Other characteristics and advantages of the invention will be clear to a person skilled in the art from the following description of particular embodiments in relation to the drawing, in which:

FIG. 1 presents two schematic views, profile at 1*a* and front view at 1*b*, of a site crane according to the invention, mounted on a caterpillar track, with the jib folded and raised, the jib head member being folded against the jib foot;

FIG. 2 is a schematic profile view, of a counterweight guiding track;

FIG. 3 compares the variations of the return force of a counterweight according to the invention with those of counterweights of the prior art;

Figure 6A:
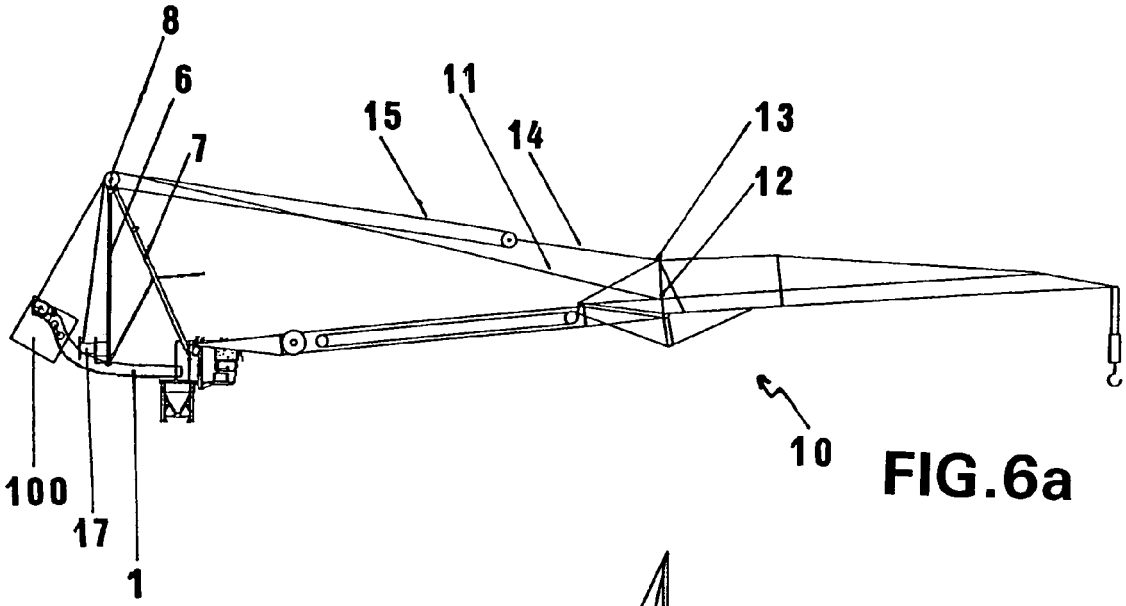
Figure 6B:
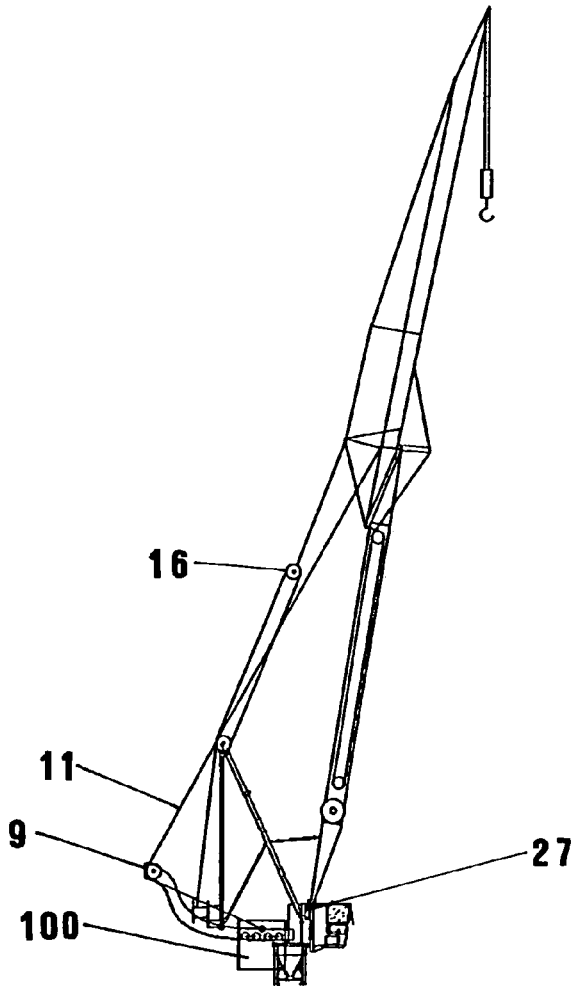
Figure 7A:
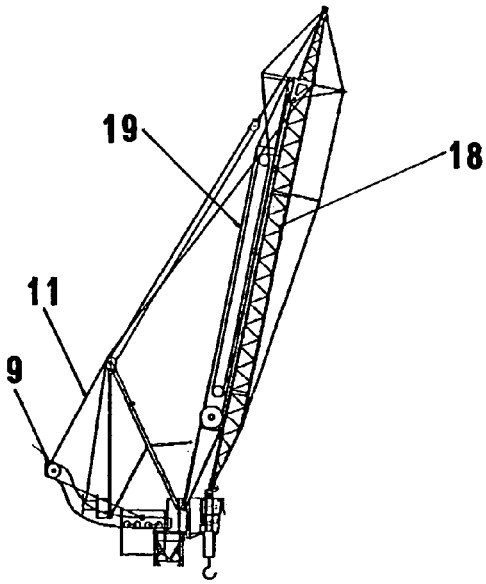
Figure 7B:
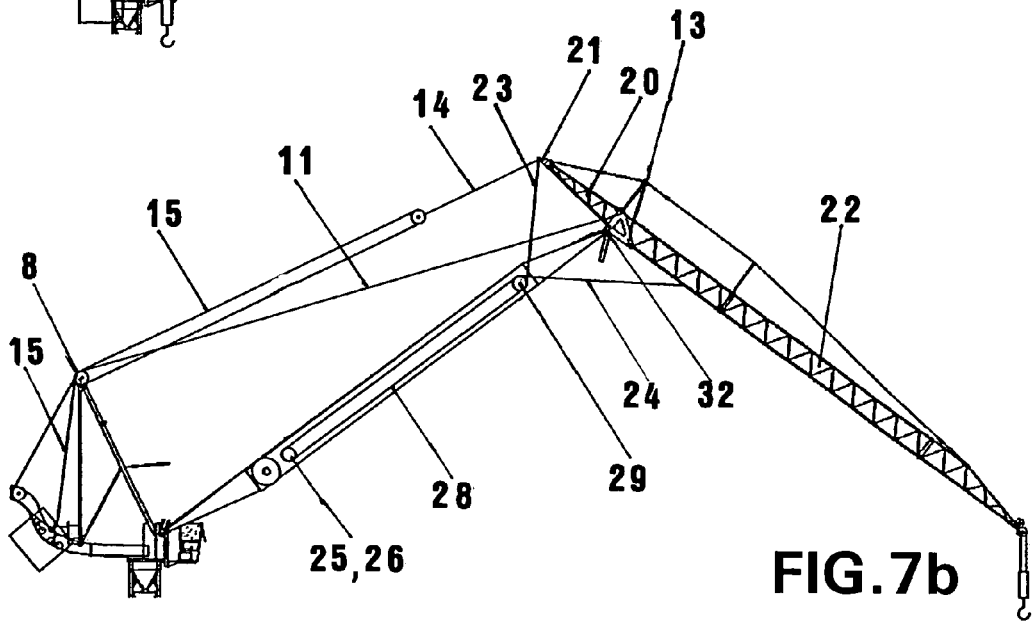
Figure 7C:
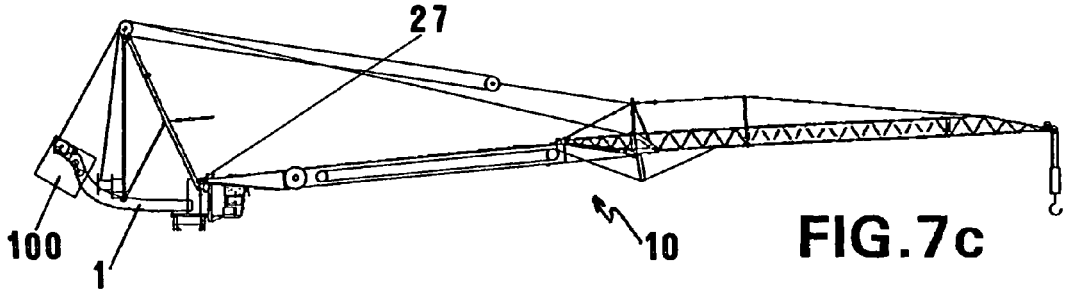

FIGS. 6*a* and 6*b* are two schematic views in profile, of a crane with luffing jib;

FIGS. 7*a*, 7*b* and 7*c* are three schematic views in profile, of a crane with articulated jib;

the FIG. 8 group, that is to say 8*a*, 8*b*, 8*c*, 8*d* and 8*e*, are detailed views illustrating the functioning of the crane in FIGS. 7*a*, 7*b* and 7*c;*

Figure 9A:
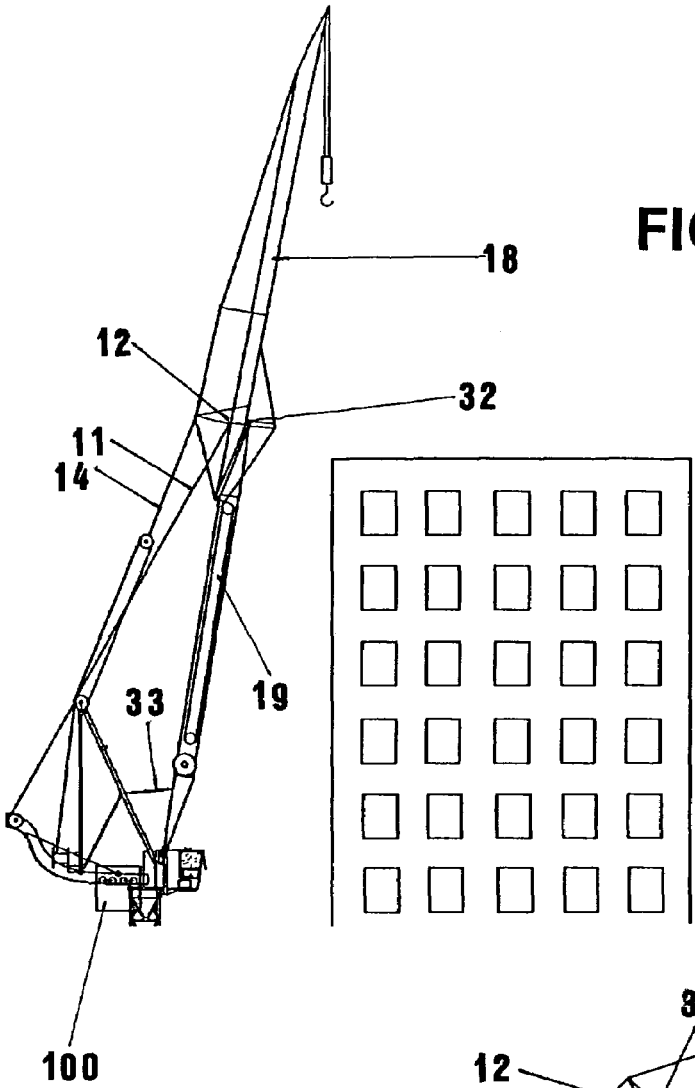
Figure 9B:
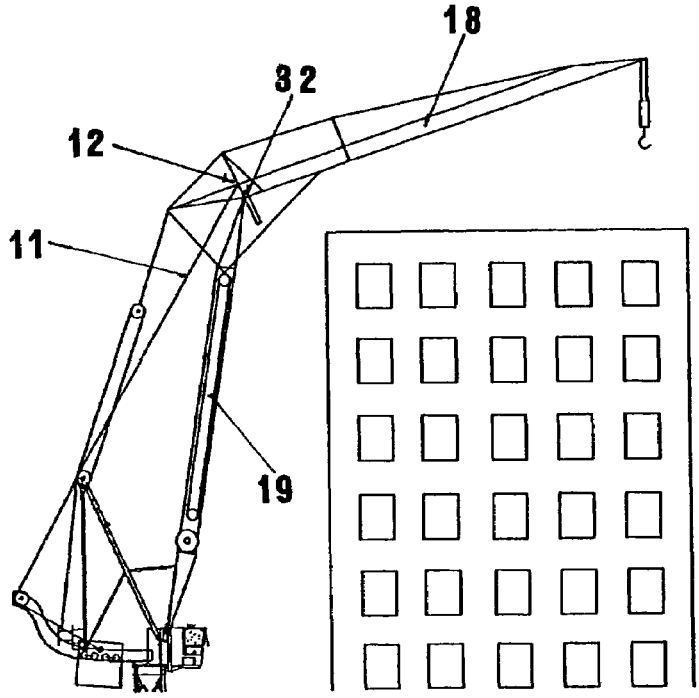
Figure 10A:
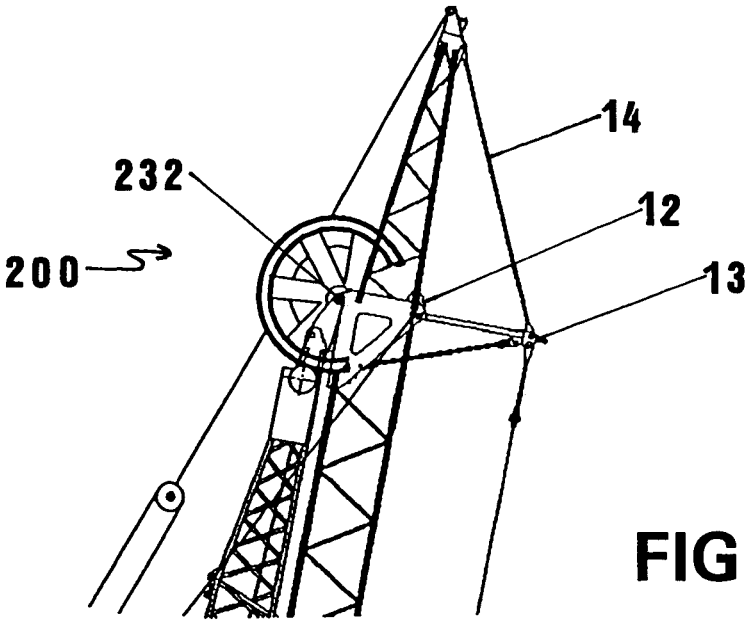
Figure 10B:
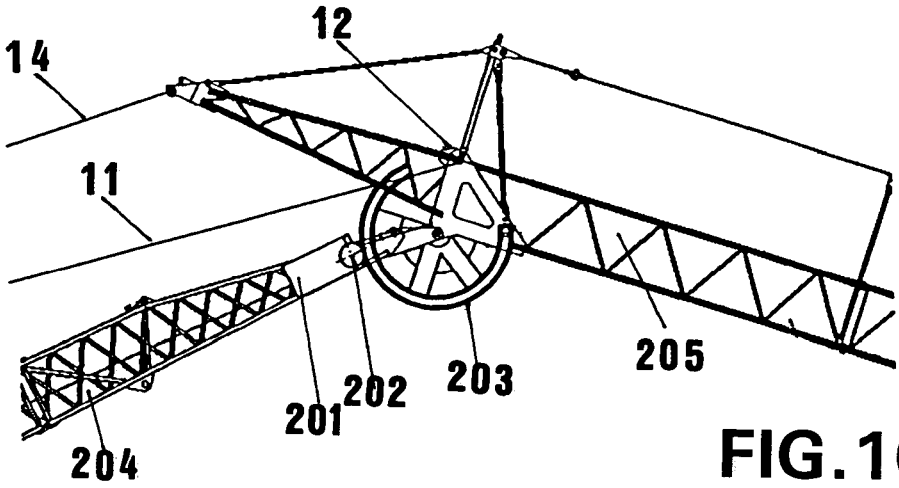
Figure 10C:
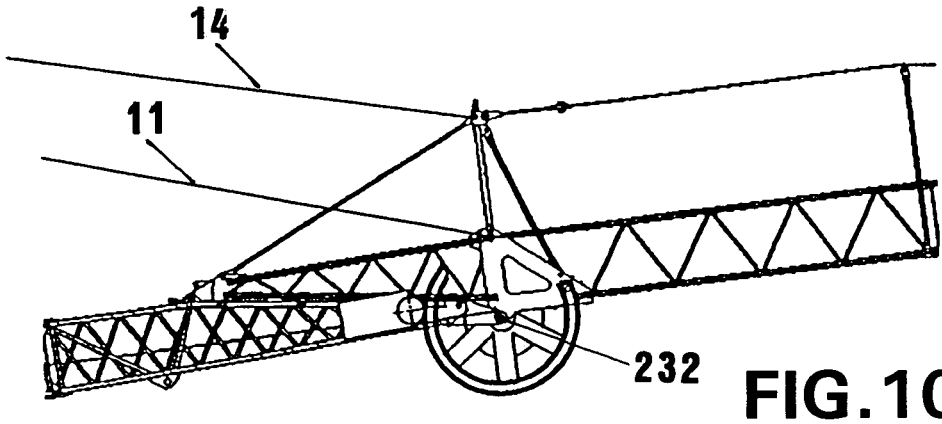
Figure 11:
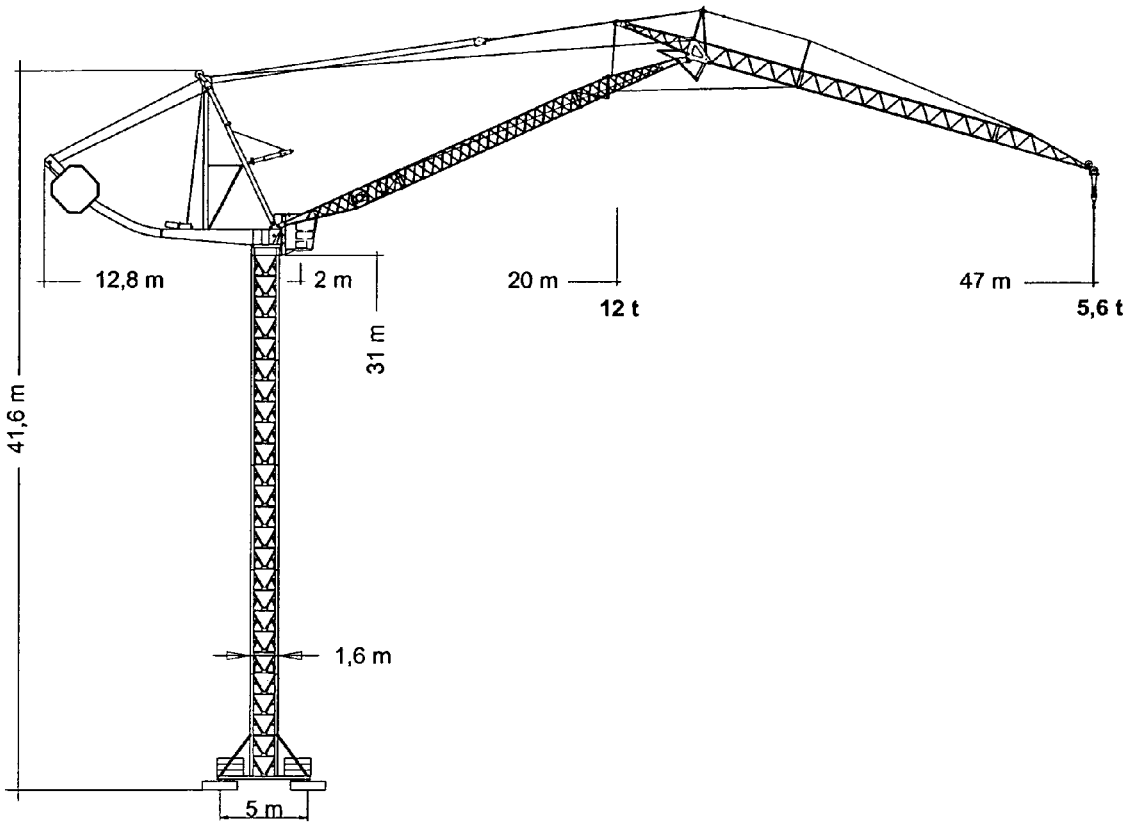

FIGS. 9*a*, 9*b* are two schematic profile views of a crane operating in working mode with inclinable jib head member;

FIGS. 10*a*, 10*b* and 10*c* are three schematic views illustrating another embodiment of a crane with articulated jib;

FIG. 11 is an overall profile view of an example embodiment of a tower crane.

Figure 2:
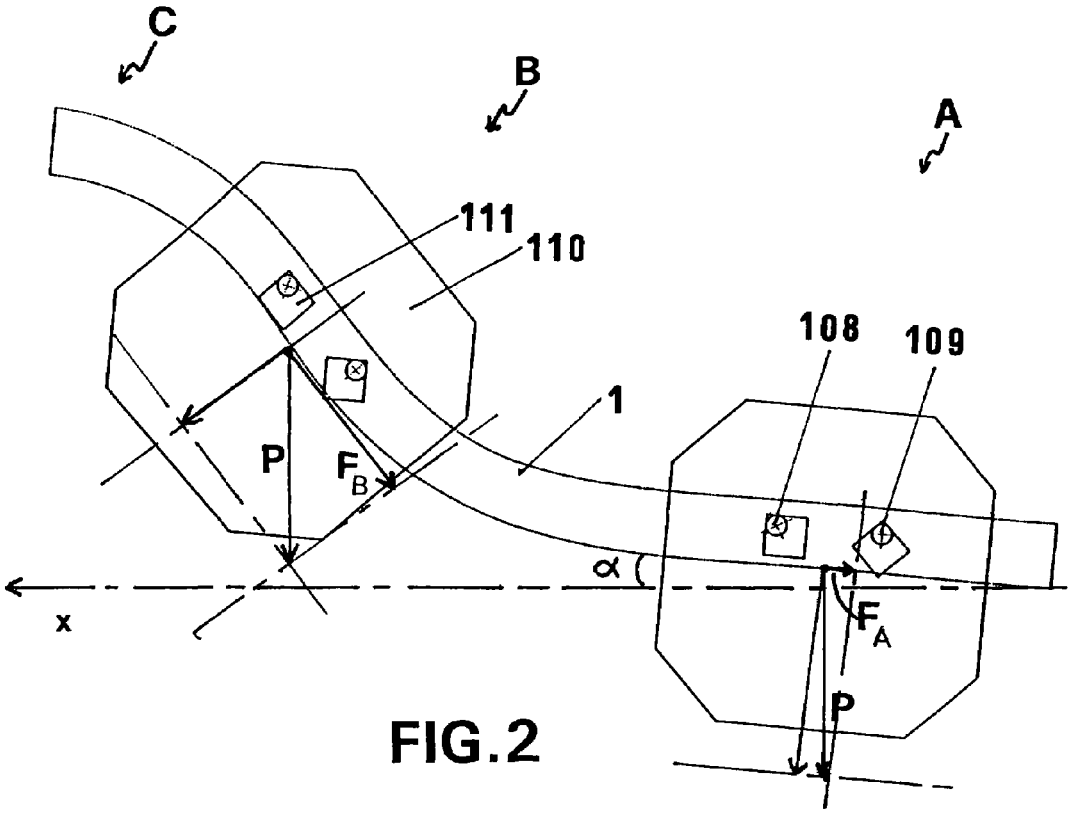

FIG. 2 is a schematic profile view of an embodiment of the guiding track 1 of the counterweight 100. By way of illustration, it has been shown with a ballast 110 in two different positions and with the support arms 108, 109 which carry it, the other elements of the crane having been omitted for reasons of simplification. The guiding track consists of two curved parallel rails 2, 3 which are both visible, in section, in FIG. 5. However, in all the lateral schematic views showing the crane, only one rail is depicted.

According to the overall dimensions of the crane, the guiding track 1 can have a length of around 5 to 20 metres. The area A, closest to the mast, has a gentle slope, forming an angle $\alpha_A$ with the horizontal of 2° to 25°. Moving away from the crane, the slope increases. In the area indicated by B in FIG. 2, the guiding track can form an angle $\alpha_B$ of around 15° to 85° with the horizontal. Finally, in the area indicated by C, close to the distal end of the guiding track with respect to the axis of the mast, the slope decreases once again, the track forming an angle $\alpha_C$ of 2° to 45°.

In FIG. 2, the components of the forces that a ballast weight exerts on the other parts of the crane have been shown diagrammatically. If the weight vector P is broken down into its components, respectively perpendicular and parallel to the axis of the track, it can be seen that, in the area A, the component parallel to the track $F_A$ is very small. The return force of the ballast on the holding line is small, but suffices to keep this line tensioned, the crab tending to return towards the mast. By way of example, if the ballast weight is 20 tonnes and the slope of $\alpha_A$ is 5°, the return force $F_A$ is around 17 kN. The ballast exerts essentially a torque on the structure of the crane, a torque which, at a distance $x_A$, is equal to approximately $P.x_A$.

In the area indicated by B, the slope is maximum and, in the embodiment depicted in FIG. 2, around 50°. The return force that the ballast exerts on the jib holding line becomes much greater. Subject to the position of the point of attachment of the holding line to the counterweight and the position of the return pulley, which is situated close to the distal end of the guiding track, but which can be arranged on the latter, or above, or below, this return force corresponds approximately to the component of the weight P parallel to this guiding track, that is to say $F_b$.

In the area C, slightly less sloping, this return force decreases once again. A person skilled in the art will without difficulty observe that, if in the area C the slope remained constant and equal to the maximum value obtained in the area B, the return force would in the area C keep the maximum value of $F_b$ reached in the area B.

Figure 3:
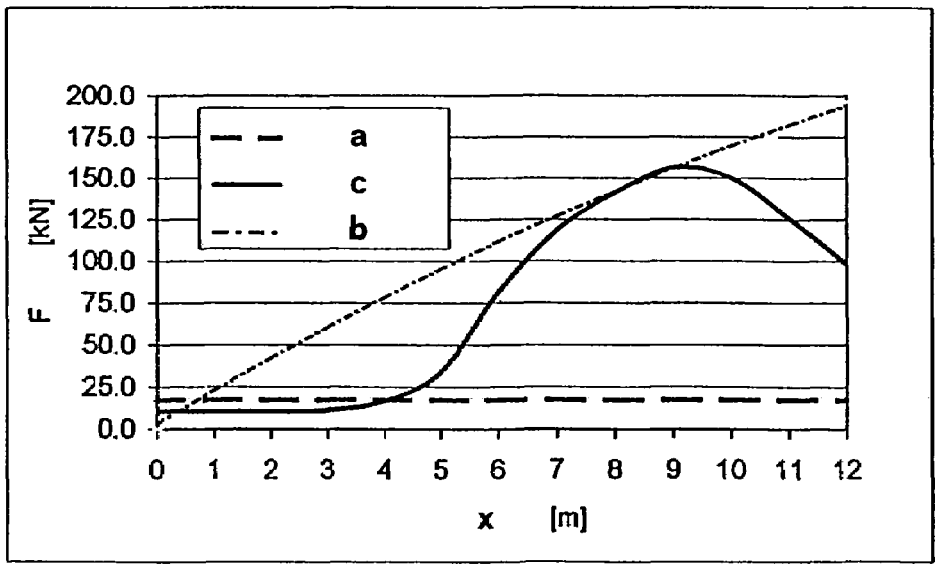

FIG. 3 depicts the return force as a function of the distance between counterweight and mast for three different counterweight systems. In the three systems, the total weight of the counterweight is 20 tonnes. The curve (a) represents the return force for a guiding track with a rectilinear profile, corresponding for example to that described in EP 0379448, with $\alpha$=5°. The curve (b) represents the return force of a pendular counterweight, attached to the end of a rocking arm 12 metres long, which is bulky, the movement taking place in the space below the platform.

The curve (c) represents the return force obtained by means of a guiding track according to the invention similar to that in FIG. 2, for which the slope is equal to 3° close to the mast, then increases up to a maximum 53° at a distance of 9 metres, and then decreases again, the slope being around 30° at the end of the track. The profile of curve (c) is determined by the choice of the profile of the guide track, that is to say by the variations in slope between areas A, B and C depicted in FIG. 2.

Figure 5:
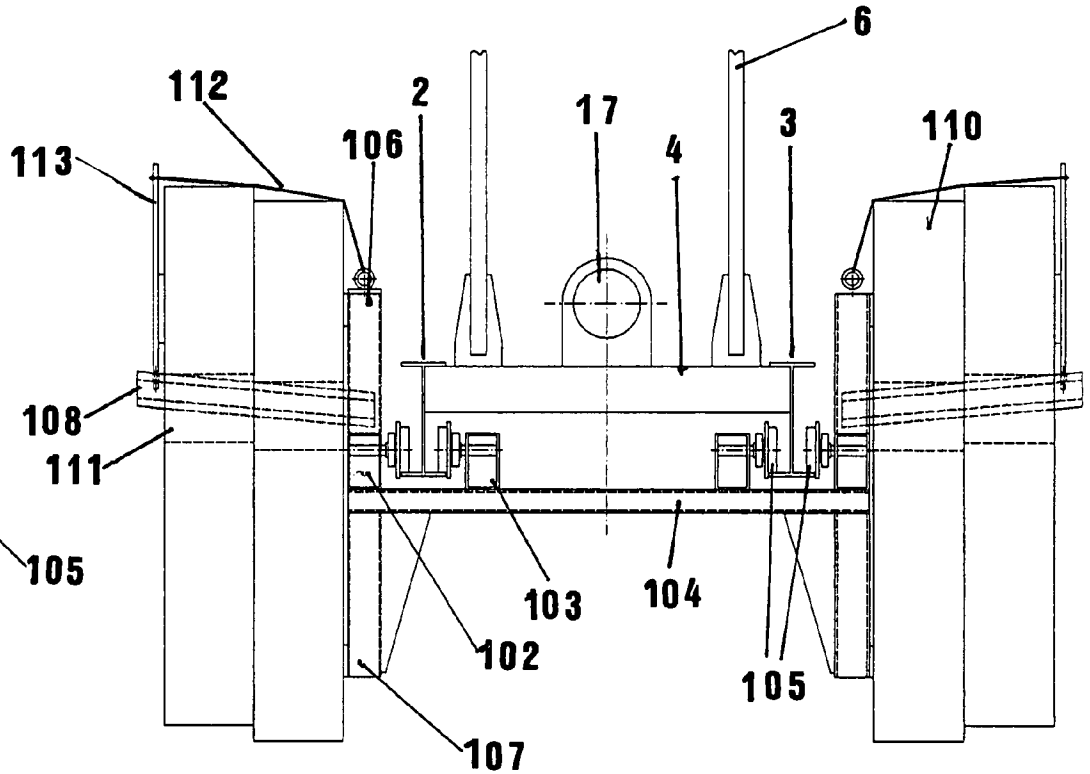
FIG. 5 is a front view of a counterweight.
Figure 4:
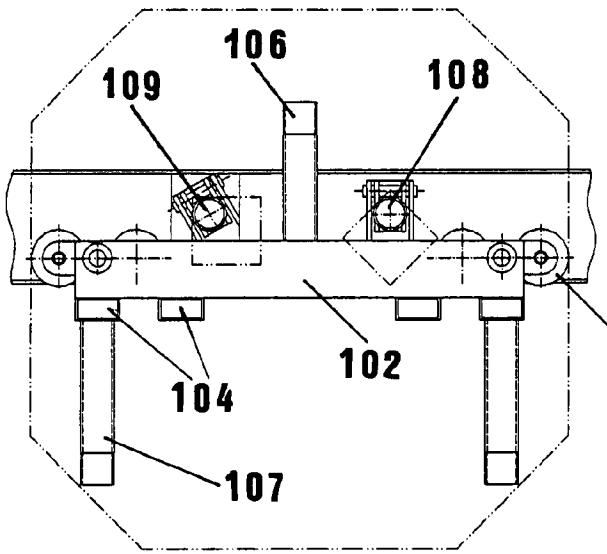
FIG. 4 is a profile view of a counterweight.

FIGS. 4 and 5 depict, respectively in profile and front view, an embodiment of the counterweight according to the invention. In these figures, the crab is generally designated by 101. The chassis of the crab consists of four longitudinal beams, two external beams 102 and two internal beams 103, connected by transverse beams 104. Each beam 102, 103 carries two running devices with rollers 105 which roll on two curved rails 2 and 3 constituting the running track. The external longitudinal beams 102 each carry three substantially vertical support beams, namely a top beam 104 and two bottom beams 107, constituting three support points. Each longitudinal beam 102 also carries two support arms 108, 109. These support arms are preferably mounted so as to be inclined in order to eliminate the clearances between ballast elements, which come to bear on one another, and against the support points. The support arms and the corresponding fixing means of the ballast elements are arranged so that the level of the centre of gravity of the counterweight is close to and preferably substantially coincides with the level of the running track at the point where the crab is situated, in order to avoid rocking during movements of the crane.

According to a variant embodiment, the support arms can be mounted on articulations making it possible to fold them, with a view to decreasing the space requirement of the crab during transport. Each pair of unfolded arms 108, 109 receives one or more ballast weights 110. As shown by FIGS. 2 and 5, these ballast weights can consist of concrete sheets provided with two holes enabling them to be attached to the support arms 108, 109. The holes 111 can be produced in the form of two squares turned angularly through 90° with respect to each other and spaced apart from each other so that the support arms 108, 109 can be placed in the corners, as shown by FIG. 2. A person skilled in the art will easily understand that this arrangement allows both an easy placing of the ballasts on the support arms, the dimensions of the holes 111 being appreciably greater than the diameter of the support arms 108, 109, and moreover prevents tilting of the weights and corresponding impacts when the moving crab moves between area A and areas B and C of the running track. Replacing of the ballast on the crab is completed by a fitting of a set of bars 113 and safety cables 112 between support arms and support beams of the crab.

The ballast sheets 110 offer to the side wind a large surface area. The action of the wind on this therefore generates a torque which partially compensates for the torque that the wind exerts on the jib. This arrangement and this conformation of the ballast sheets therefore assist the horizontal rotation of the rotating part above the pivot, that is to say the distribution of loads.

A person skilled in the art will also see in FIG. 5 that the two curved rails 2 and 3 are connected by a set of transverse beams 4, thus constituting a kind of platform which can receive one or more winches 17, stanchions or stanchion tie rods 6.

Figure 1A:
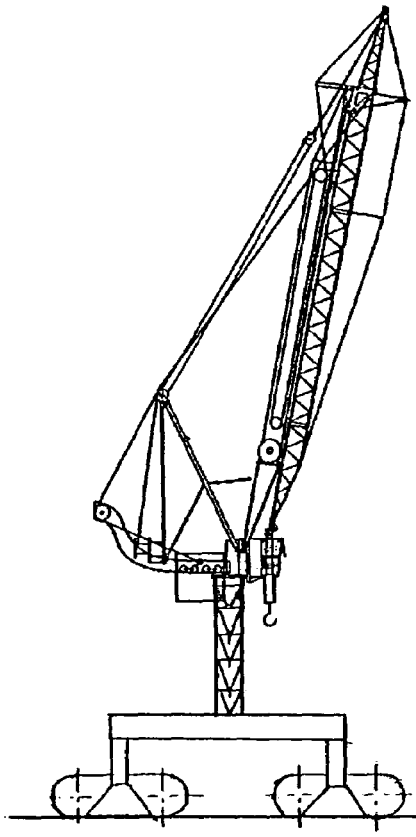
Figure 1B:
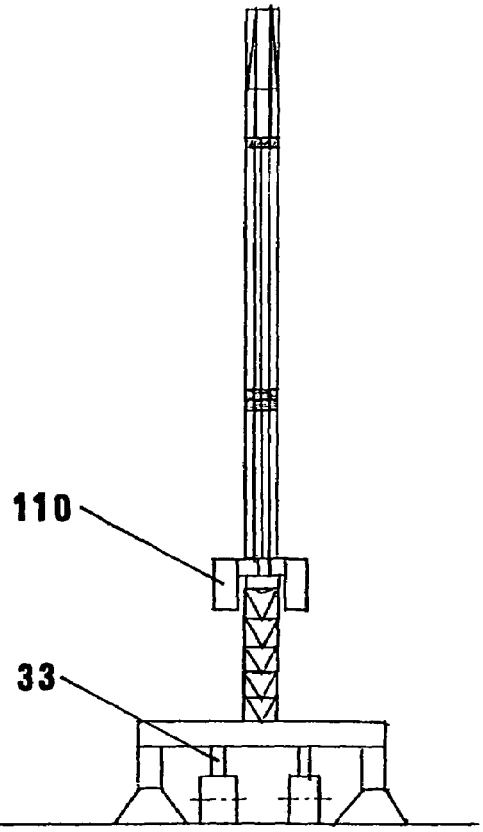

FIGS. 1*a* and 1*b* show a crane with articulated jib, the jib foot raised to the maximum and the jib head member folded against the jib foot, on a running chassis. In the position where the jib foot is fully raised, the ballast weights come very close to the mast, framing it on each side, as shown in FIG. 1*b*. In this position, the ballast weights on the one hand and the weight of the jib on the other hand exert relatively low forces on the tower and the running chassis of the crane, so that it is possible to move the crane upright on the site, by means of a caterpillar track, without its being necessary to dismantle the crane to move it. Jacks 33 can make it possible to raise and adjust the level of the crane during such a movement.

FIGS. 6*a* and 6*b* show the functioning of the counterweight on a lifting machine whose jib is functioning in luffing working mode. FIG. 6*a* shows the machine, the jib 10 being almost horizontal, in the maximum reach position. The counterweight 100, represented in a simplified manner by a square ballast and a set of rollers, runs on the guiding track 1 and is connected to the jib only by the holding line or lines 11, so that its movement is slaved to the movement of the jib simply and solely by this line or lines 11. In FIG. 6*a*, the counterweight 100 is in the distal area of the track 1 with respect to the axis of the tower. In FIG. 6*b*, the jib 10 is raised in the minimum reach position. The jib holding line 11 is fixed at its first end to the counterweight 100. It passes over a return pulley 9 arranged at the distal end of the guiding track and over a second return pulley 8 arranged at the top of the stanchion 7. The other end of the holding line 11 is fixed at 12 to the jib, at the same level as the frame 13. The frame 13 serves an attachment point for the lifting device. The lifting device can consist of several parts, namely a lifting tie rod 14, connecting the lifting frame to a pulley or pulley block 16, and a lifting cable 15, which can make several turns of the pulley block. The lifting cable 13 is connected to a lifting winch 17, the drum of which is arranged on the platform fixed to the guiding track.

The jib holding line 11 cooperates with the raising motor device in order to raise the jib. Referring to FIG. 3, it will be seen that its contribution is important in the middle positions and the positions close to that shown by FIG. 6*a*, that is to say when a high raising torque is necessary, and small in the positions close to that of FIG. 6*b*, that is to say when the raising motor device needs only a small torque. The counterweight system according to the invention therefore makes it possible to reduce the maximum nominal torque of the raising device. If it is wished to obtain a return component F assisting the raising device to the maximum extent in the positions close to that in FIG. 6*a*, the guiding track can have its highest slope in its distal portion.

It should be noted that the jib 10 shown in FIGS. 6*a* and 6*b* can be a rigid jib or an articulated jib like the one in FIG. 7*c*.

FIGS. 7*a*, 7*b* and 7*c* illustrate the functioning of an articulated jib functioning in horizontal articulated distribution mode. FIG. 7*a* similar to FIG. 1*a*, shows the jib in the minimum reach position, with the jib head member 18 folded against the jib foot 19. FIG. 7*c* shows the jib 10 in a position similar to that in FIG. 6*a*, in the maximum reach position, the jib foot and the jib head member being aligned.

FIG. 7*b* shows the jib in an intermediate deployment position. A person skilled in the art will note in particular that, in the position illustrated by FIG. 7*b*, the counterweight 100 is approximately halfway along its travel and that the traction component on the holding line 11 of the jib is high. The jib raising tie rod 14 attached to the frame 13 passes over the end 21 of the counter jib head member 20 which returns it. The articulation 32 formed by a horizontal rotation axis between the jib foot 19 and the jib head member 18 delimits the latter between jib head member tip 22 and counter jib head member 20. It is at this level that the holding line 11 is attached to 12. The rotation of the jib head member about the articulation axis 32 is effected by means of two opposing cables 23 and 24. The attachment point of the opposing cable 23 is situated at the end of the counter jib head member 20 in order to obtain the greatest lever arm with respect to the articulation 32, in order to reduce the forces in the cable 23 and the power required of the electric winch 25 that actuates it. In order to obtain an even behaviour of the two opposing cables, the attachment point of the cable 24 on the jib head member 22 is situated approximately at the same distance as the cable 23 with respect to the articulation 32. A return pulley 29 for the cables 23, 24 is arranged in the jib foot, in an area close to the articulation 32 between jib foot and jib head member, as illustrated in FIG. 7*b*. The winches 25, 26 for winding the cables 23 and 24 are arranged in the jib foot close to the articulation 27 of the first end of the jib foot at the top of the mast in order to obtain better equilibrium of the crane by returning the inherent weights of the various elements of the winches 25 and 26 as far as possible towards the centre of the mast. This location also improves maintenance because the winches are situated close to the rotating pivot.

The attachment point 12 of the line 11 situated on the jib head member 18 describes an arc of a circle around the articulation axis 32 in order to optimise the movement of the counterweight so as to improve the equilibrium of the crane.

Figure 8A:
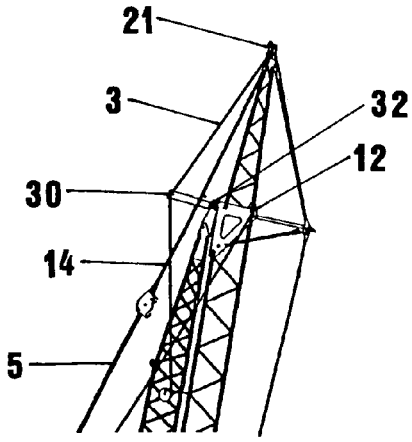

The functioning of the horizontal distribution from the minimum reach (FIG. 7*a*) as far as the maximum reach, FIG. 7*c*, in articulated working mode, is illustrated in more detail by FIGS. 8*a*, 8*b*, 8*c*, 8*d* and 8*e*. FIG. 8*a* shows the area of the jib surrounding the jib foot/jib head member articulation in the position in FIG. 7*a*. It should be noted that the jib holding line or lines pass a little below and to the right of the jib foot/jib head member articulation 32; the raising cable 15 and the raising tie rod 14 for the jib pass over the end 21 of the counter jib head member and are situated a little to the left of the articulation 32 between jib foot and jib head member. The cables 23 and 24 have opposing effects. From this position, the top cable 23 is controlled by the crane driver and the bottom cable 24 unwinds. The top cable 23 is diverted by the rod 30.

Figure 8C:
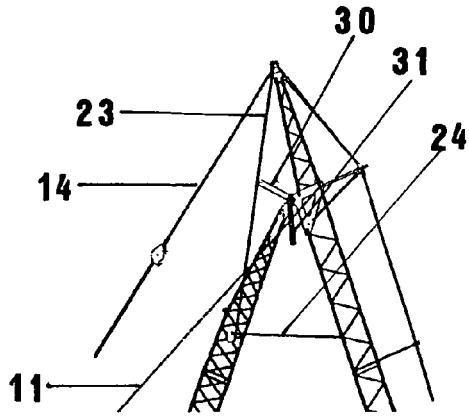
Figure 8B:
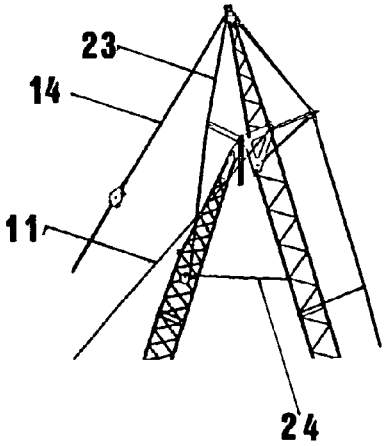

In the position shown by FIG. 8*b*, the top cable 23 pulls on the counter jib head member, in order to continue the deployment operation, the top rod 30 still diverting the top cable 23. The bottom cable 24 is then drawn by the top cable 23, the speed being controlled by the crane driver.

At the stage shown by FIG. 8*c*, the top cable 23 is still pulling on the counter jib head member, in order to continue the deployment movement, but the top rod 30 is no longer diverting the top cable 23. The bottom cable 24 is still drawn by the top cable.

Figure 8D:
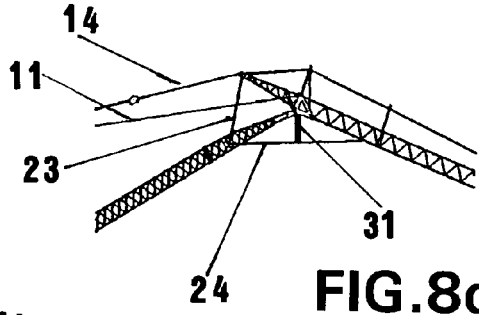

At the stage shown by FIG. 8*d*, the top cable 23 is still pulling on the counter jib head member in order to continue to deploy the jib, and the bottom cable 24 is still being drawn by the top cable. It will be noted that the bottom cable 24 comes into contact with the bottom rod 31 and that the holding line 11 has gone beyond the articulation 32 between jib foot and jib head member.

Figure 8E:
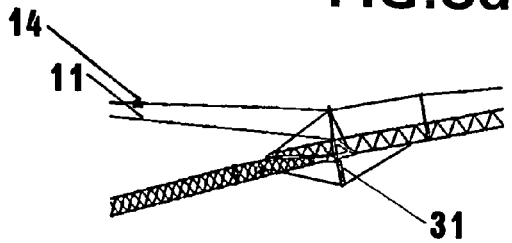

In the position illustrated by FIG. 8*e*, the raising tie rod 14 is no longer in contact with the end 21 of the counter jib head member. The bottom rod 31 increases the traction angle of the bottom cable 24 in order to reduce the forces thereon and to ensure the stability of the elements around the articulation 32.

For the portion of the deployment that is situated between FIGS. 8*d* and 8*e*, it may be preferred for the contribution of the return force F of the jib holding line 11 to decrease in favour of the torque C. In this case, the distal area of the guiding track 1 indicated as area C in FIG. 2 may have a slope less than the slope of the area B.

FIGS. 9*a* and 9*b* illustrate the working mode with inclinable jib head member of the articulated jib previously described in relation to the groups in FIGS. 7 and 8. Between the two positions in FIGS. 9*a* and 9*b*, the jib foot 19 does not move, it is in abutment against a stop device 33. Such stop devices are known in the prior art. The moving counterweight 100 is situated in the two positions in an area of low slope of the running track, close to the mast. However, because of the non-zero distance between the attachment point 12 of the jib holding line and the articulation 32 between the jib foot and the jib head member, this attachment point 12 describes an arc of a circle around the articulation 32 of the jib, driving the counterweight in a limited movement. The variations in moment of the counterweight vis-à-vis the mast which result therefrom balance the variations in the moment of the weight of the jib due to the rotation of the jib head member. The rotation of the jib head member about the articulation 32 with the jib foot is provided by the opposing cable systems 24 and 23 in the same way as disclosed above in relation to the group in FIG. 8.

In all the positions of the reach defined by the crane driver, the stability of the end of the jib is provided by an electromechanical brake actuated when the power is cut off, installed on the motors of the cables 23 and 24.

In another embodiment of the lifting machine according to the invention, illustrated by FIGS. 10*a*, 10*b* and 10*c*, the set of opposing cables 23 and 24 with their winding and unwinding winches 25, 26 arranged in the jib foot is replaced by a gear system 200 composed of a motor 201, a pinion 202 and a toothed segment 203, arranged at the articulation 232 between the jib foot 204 and the jib head member 205. The electric motor 201 is fixed to the jib foot and drives a pinion 202 which itself meshes with a circular toothed segment 203 fixed to the jib head member, in order to provide the rotation of the jib head member around the articulation 232 between jib foot and jib head member. The arrangement and function of the jib holding line 11 and of the raising tie rod 14 are the same as those in the embodiments described above.

EXAMPLE

Multipurpose Tower Crane

FIG. 11 illustrates schematically an example of an embodiment of a tower crane according to the invention. The base chassis has a wheel base of 5×5 metres and carries a base ballast of 46 tonnes. The base chassis is surmounted by a tower having a height under the cabin of 31 metres and a rotating pivot. The latter carries a platform, the cabin and the jib as well as the guiding track on which the moving ballast travels. A total weight of the crane empty in operating order is 111.6 tonnes.

The guiding track integral with the pivot rotating at the top of the mast extends from the mast to a distance of 12 metres from it. It consists of a pair of rails connected by struts. Each rail comprises a first rectilinear portion with a slope of 5°, extending from the rotating pivot up to a distance of 6 metres, a second rectilinear portion with a slope of 29° extending from a distance of 6 metres as far as a distance of 8 metres from the mast, and a third rectilinear portion with a slope of 43°, corresponding to the last two metres of the track. Between the first and second rectilinear portions on the one hand and the second and third rectilinear portions on the other hand there are situated two curved intermediate portions, forming the rounded parts of the rails, which are therefore roughly curvilinear.

The guiding track, which also constitutes the platform, carries the jib raising winch, which has a power of 22 kW. The guiding track is surmounted by a set of stanchions and stanchion tie rods carrying the return pulleys. The whole rises to a height of approximately 41.6 metres.

On this guiding track there runs a crab with rollers carrying on each side respectively two concrete sheets each weighing 6.5 tonnes.

The jib foot houses, close to its articulation with the rotating pivot of the mast, the winches for deploying/retracting the jib in articulated working mode, with a power of 7.5 kW, and the load lifting winch with a power of 45 kW. The corresponding return pulleys are also housed in the jib foot close to the articulation with the jib head member. The operating mode of the articulated jib was described above in relation to FIGS. 6*a* to 8*e*.

In articulated working mode, the crane can move a maximum load of 12 tonnes at reduced speed, or a load of 10 tonnes at normal speed, and this in an area from 2 to 20 metres from the foot of the mast. The distributable load reduces at a greater distance from the foot of the mast. The maximum load is 5.6 tonnes at reduced speed and 4.7 tonnes at normal speed at the maximum working reach, that is to say 47 metres. The speed of movement can vary from 0 to 60 metres per minute.

In luffing working mode, the maximum movable load is 12 tonnes when the reach is between 5 and 20 metres. The maximum load reduces to 5.6 tonnes at a maximum reach of 47 metres. The maximum hook height in luffing mode is 80 metres. The speed of movement in luffing mode can vary from 0 to 30 metres per minute.

When the crane is dismantled, it can be transported in separate parts by means of five trailers with lengths of between 6 and 12 metres, each of the trailers transporting a set of parts of 19.5 to 25 tonnes.

If the user makes provision for using the crane solely in articulated working mode, in horizontal movement, the jib raising winch can be omitted and the lifting and pulley block is replaced by two metal tie rods. This reduces the cost price of the crane and the number of parts.

The invention claimed is:

1. A tower crane for lifting and handling loads with an orientable articulated placing jib, comprising:

a mast with a rotating pivot;

an articulated jib comprising a jib foot, articulated at its first end on the top of the mast by means of a horizontal rotation shaft, and a jib head member articulated for rotation by means of a horizontal articulation shaft on the second end of the jib foot;

a jib holding assembly comprising at least one stanchion attached to the mast or the pivot and extending above the mast, a jib holding cable attached on the jib and guided over a pulley on said stachion, and a moving counterweight connected to the jib by the said jib holding cable; and, a guiding track rigidly secured to the rotating pivot opposite to the jib, said guiding track having a varying slope, wherein said guiding track has at least a first portion and a second portion, said first portion being closer to the mast than said second portion, with the proviso that the slope in the first portion is smaller than the slope in the second portion, said guiding track supporting the said counterweight, and wherein variations in said slope are such that the counterweight exerts a set of variable forces on the said jib and on the structure of the said machine, contributing to balancing the machine during movements of deployment/retraction of the jib in articulated working mode.

2. A tower crane according to claim 1, wherein the guiding track has, in its portion closest to the mast, a slope less than a slope in at least a portion further away from the mast.

3. A tower crane according to claim 1, wherein the guiding track (1) has a curvilinear profile.

4. A tower crane according to claims 1, wherein the guiding track has a sigmoidal, s-shaped profile.

5. A tower crane according to claim 1, wherein the guiding track consists of a pair of parallel curvilinear rails, and wherein the counterweight comprises a moving crab comprising running means running on the said rails and ballast elements carried by the said crab.

6. A tower crane according to claim 5, wherein the crab comprises a chassis and, on each of the lateral sides of the chassis, support elements for receiving and carrying the said ballast elements on each side of the rails so that the level of the centre of gravity of the counterweight is close to the level of the guiding track.

7. A tower crane according to claim 6, wherein the said support elements are pairs of arms arranged in an inclined position, wherein said ballast elements consist of sheets each having holes with a surface area greater than the cross section of the support arms and configured so that the ballast sheets suspended from a pair of associated support arms is held in an immobile position with respect to the said crab whatever the position of the crab on the guiding track and parallel to the said guiding track.

8. A tower crane according to claim 1, further comprising a jib raising device making the machine capable of working in articulated mode and in luffing mode, wherein the jib head member comprises, on each side of its articulation axis on the jib foot, respectively a jib head member tip and a counter jib head member, the said second end of the jib foot and the counter jib head member having conjugate shapes enabling the jib head member tip to come into a position aligned with the jib foot in the luffing working position and wherein variations in slope of the guiding track are such that the variable traction on the jib assist the luffing device and/or the changes in conformation of the jib associated with a change in working mode.

9. A tower crane according to claim 1, wherein the end of the said jib holding cable is fixed to the jib head member.

10. A tower crane according to claim 9, wherein the point of attachment of the end of the jib holding cable is arranged between the jib head member tip and the counter jib head member.

11. A tower crane according to claim 10, wherein the said attachment point is arranged at a distance from the articulation between jib foot and jib head member so as to describe an arc of a circle about the articulation axis, and wherein the said jib holding cable crosses the jib foot/jib head member articulation axis during the deployment of the jib in articulated working mode between the minimum reach position and the maximum reach position.

12. A tower crane according to claim 1, wherein the rotation of the jib head member about the jib foot/jib head member articulation is controlled by means of a system of opposing cables.

13. A tower crane according to claim 12, wherein said system of opposing cables comprises a first cable, fixed to the end of the counter jib head member at a first point of attachment, and a second cable fixed to the tip of the jib head member at a second point of attachment, wherein a distance from said articulation to said second point of attachment is approximately the same as a distance from the first point of attachment to said articulation.

14. A tower crane according to claim 12, wherein the said system of opposing cables comprises electric winches and return pulleys housed on the jib foot.

15. A tower crane according to claim 14, wherein the electric winches are housed close to the first end of the jib foot and the return pulleys close to the second end of the jib foot.

16. A tower crane according to claims 1, wherein the rotation of the jib head member about the end of the jib foot is effected by means of a gear system comprising an electric motor, a pinion and a toothed segment.

17. A tower crane according to claim 16, wherein the said electric motor is fixed to the jib foot and drives, via the said pinion, a circular toothed segment fixed to the jib head member.

18. A tower crane according to claim 1, wherein the rotation of the jib head member about the jib foot/jib head member articulation is actuated by a device fixed on the jib foot.

19. A tower crane according to claim 18, wherein said device comprises an electric motor and/or an electric winch.

20. A machine for lifting and handling loads with an orientable articulated placing jib, comprising a mast with a rotating pivot, an articulated jib comprising a jib foot, articulated at its first end on the top of the mast by means of a horizontal rotation shaft, a jib head member articulated for rotation by means of a horizontal articulation shaft on the second end of the jib foot, a jib holding assembly comprising at least one stanchion, a jib holding line and a moving counterweight connected to the jib by the said jib holding line, wherein the machine further comprises a guiding track rigidly secured to the rotating pivot opposite to the jib, said guiding track having a varying slope and supports said counterweight and wherein variations in said slope are such that the counterweight exerts a set of variable forces on the said jib and on the structure of the said machine, contributing to balancing the machine during movements of deployment/retraction of the jib in articulated working mode, wherein said guiding track consists of at least one curvilinear rail, and wherein the counterweight comprises a moving crab comprising running means running on the said at least one rail and ballast elements carried by the said crab, said crab comprising a chassis and, on each of the lateral sides of the chassis, support elements for receiving and carrying the said ballast elements on each side of the at least one rail so that the level of the centre of gravity of the counterweight is close to the level of the guiding track.

21. A machine for lifting and handling loads with an orientable articulated placing jib, comprising a mast with a rotating pivot, an articulated jib comprising a jib foot, articulated at its first end on the top of the mast by means of a horizontal rotation shaft, a jib head member articulated for rotation by means of a horizontal articulation shaft on the second end of the jib foot, a jib holding assembly comprising at least one stanchion, a jib holding line and a moving counterweight connected to the jib by the said jib holding line, wherein the machine further comprises a guiding track rigidly secured to the rotating pivot opposite to the jib, said guiding track having a varying slope and supports said counterweight and wherein variations in said slope are such that the counterweight exerts a set of variable forces on the said jib and on the structure of the said machine, contributing to balancing the machine during movements of deployment/retraction of the jib in articulated working mode, wherein the rotation of the jib head member about the jib foot/jib head member articulation is controlled by means of a system of opposing cables comprising electric winches and return pulleys housed in the jib foot.

* * * * *

UNITED STATES PATENT AND TRADEMARK OFFICE

CERTIFICATE OF CORRECTION

PATENT NO. : 7,331,476 B2
APPLICATION NO. : 10/571982
DATED : February 19, 2008
INVENTOR(S) : Manfred Georg Stohr It is certified that error appears in the above-identified patent and that said Letters Patent is hereby corrected as shown below:

On the Title Page, Item 56, should read

Other References Cited

Database WPI: Section PQ, Week 197744, Derwent Publications Ltd., London, GB; Class Q38, AN 1977-J9307Y & SU 524762A (Soroka) 11 November 1976

Database WPI: Section PQ, Week 198823, Derwent Publications Ltd., London, GB; Class Q38, An 1988-155526 XP002269405 & DD253240A (Tech Hock Von Guer) 13 January 1988

Signed and Sealed this

Seventeenth Day of June, 2008

JON W. DUDAS
*Director of the United States Patent and Trademark Office*